US009084996B2

(12) United States Patent
Chien et al.

(10) Patent No.: US 9,084,996 B2
(45) Date of Patent: Jul. 21, 2015

(54) REAGENT SLOT, SAMPLE TRAY AND COMBINATION KIT USED IN BIOCHEMICAL TEST

(71) Applicant: Taiwan Advanced Nanotech Inc., Taoyuan (TW)

(72) Inventors: Chien-Hsing Chien, Taoyuan (TW); Yu-Sheng Yang, Taoyuan (TW)

(73) Assignee: TAIWAN ADVANCED NANOTECH INC., Taoyuan, Taoyuan County (TW)

( * ) Notice: Subject to any disclaimer, the term of this patent is extended or adjusted under 35 U.S.C. 154(b) by 296 days.

(21) Appl. No.: 13/722,097

(22) Filed: Dec. 20, 2012

(65) Prior Publication Data

US 2013/0272931 A1 Oct. 17, 2013

(30) Foreign Application Priority Data

Apr. 13, 2012 (TW) ..... 101206799

(51) Int. Cl.
*B01L 3/00* (2006.01)
*B01L 9/00* (2006.01)

(52) U.S. Cl.
CPC ..... *B01L 3/5085* (2013.01); *B01L 3/50855* (2013.01); *B01L 3/527* (2013.01); *B01L 9/00* (2013.01); *B01L 3/50851* (2013.01); *B01L 2300/0829* (2013.01)

(58) Field of Classification Search
CPC ..... A47B 73/00; B01L 2300/0829; B01L 3/5085; B01L 3/50851; B01L 3/50855; B01L 3/527; B01L 9/00
USPC ..... 422/552, 561, 553, 560, 522, 104
See application file for complete search history.

(56) References Cited

U.S. PATENT DOCUMENTS

| | | | | |
|---|---|---|---|---|
| 4,849,177 | A * | 7/1989 | Jordan | 422/64 |
| 6,485,690 | B1 * | 11/2002 | Pfost et al. | 422/552 |
| 6,533,133 | B2 * | 3/2003 | Liu | 211/74 |
| 7,191,904 | B2 * | 3/2007 | Wescott, III | 211/74 |

* cited by examiner

*Primary Examiner* — Sally Merkling
(74) *Attorney, Agent, or Firm* — Bacon & Thomas, PLLC

(57) ABSTRACT

The present invention relates to a reagent slot, a sample tray and a combination kit used in biochemical test; this reagent slot is used to be mounted in the sample tray. Specifically, the reagent slot has a main frame which has plural holding holes, and the sample tray includes a plate portion, which is equipped with plural inserting holes and plural inserting slots, and a support portion which is used to support the plate portion.

15 Claims, 4 Drawing Sheets

REAGENT SLOT, SAMPLE TRAY AND COMBINATION KIT USED IN BIOCHEMICAL TEST

BACKGROUND OF THE INVENTION

1. Field of the Invention

The present invention relates to a reagent slot, a sample tray and a combination kit used in biochemical test, in particular, it relates to a combination kit used in biochemical test which can avoid consumable waste.

2. Description of the Related Art 96-well plate, 8-Tube Strips and 12-Tube Strips are common utensils used for containing biochemical specimens. The commercially available 96-well plate dedicated to polymerase chain reaction (PCR) has 96 slots in total which may be used for loading biochemical specimens, but not all the 96 slots have to be used in every detection; even though only six slots are used, all the 96 slots must be discarded after use in order to avoiding other slots being polluted. Therefore, such practice is wasteful and non-effective.

The commercially available 8-Tube Strips and 12-Tube Strips may improve the shortcoming of 96-well plate described above, however, the specimens it may contain are limited because of its small volume of 0.2 mL so that it is confined to some extent in application.

SUMMARY OF THE INVENTION

In view of the aforesaid deficiency, the present invention intends to develop a combination kit which can avoid consumable waste.

In order to reach the above purpose, the present invention offers a reagent slot comprising a main frame having plural holding holes.

In a preferable embodiment, this holding hole is used for loading reaction reagent.

In a preferable embodiment, this reagent slot has 4 to 12 holding holes.

The present invention also offers a sample tray which includes a plate portion setting with plural inserting holes and plural inserting grooves and a support portion which is used to support the plate portion.

In a preferable embodiment, the inserting hole is used for holding the tube capable of loading sample.

In a preferable embodiment, the tube is a test tube or a centrifuge tube.

In a preferable embodiment, the sample is a specimen, a lysis solution or a cleaning solution.

In a preferable embodiment, the inserting grooves are used for holding the reagent slot capable of loading a reaction agent.

In a preferable embodiment, the plate portion is equipped with 48 to 90 holes.

In a preferable embodiment, the plate portion is equipped with 1 to 8 inserting grooves.

In a preferable embodiment, the plate portion is flat.

In a preferable embodiment, six inserting holes and one inserting groove in each row and eight rows in total are positioned in the plate portion.

In a preferable embodiment, the support portion is equipped with one groove on which at least one heat conducting block is mounted.

The present invention also offers a combination kit used in biochemical test, and the combination kit includes the aforesaid reagent slot and sample tray.

For the number of reagent slots in the combination kit of the present invention may be decided according to the quantity of specimens, consumable waste can be reduced.

DETAILED DESCRIPTION OF THE PREFERRED EMBODIMENTS

The advantages and technical features are illustrated herein by using embodiments of the present invention, but it will be understood by those skilled in the art that a variety of modifications and variations may be made to the present invention without departing from the spirit or scope of the present invention; the scope of which should be defined in the appended claims and their equivalents.

Figure 1:
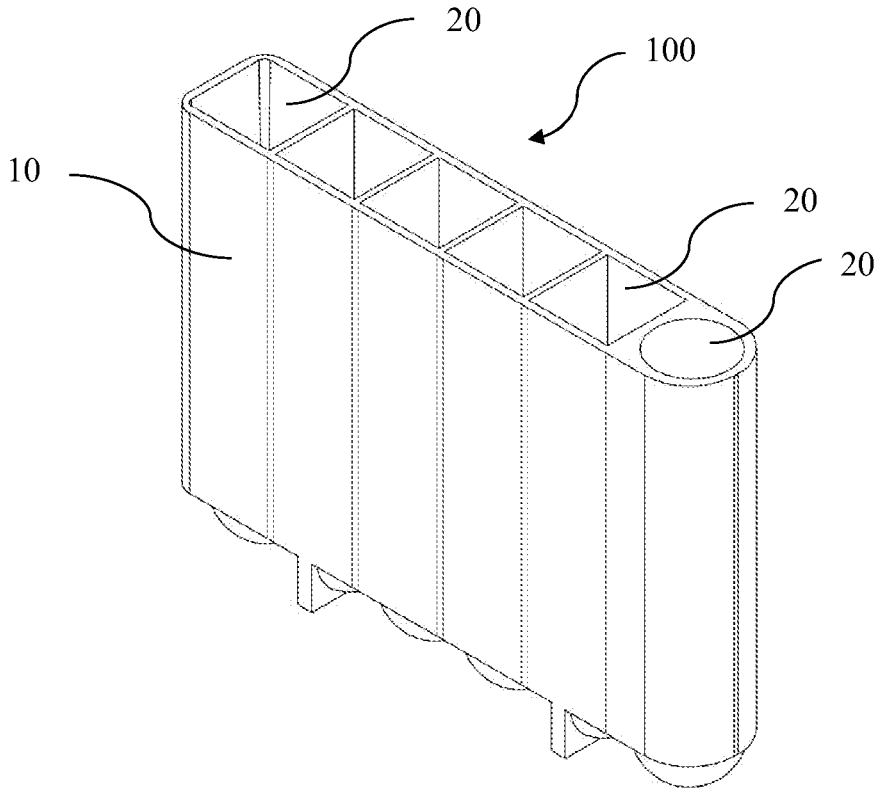
FIG. 1 is a schematic diagram for reagent slot of the disclosure.

Please refer to FIG. 1 which illustrates the reagent slot of the present invention. As shown in FIG. 1, the reagent slot 100 of the present invention has a main frame 10 which has plural holding holes 20. The material of main frame 10 may be conventional material of 8-Tube Strips, such as, polypropylene, polyethylene, polycarbonate or PVC; in the present embodiment, the material of the main frame 10 is polypropylene.

Figure 2:
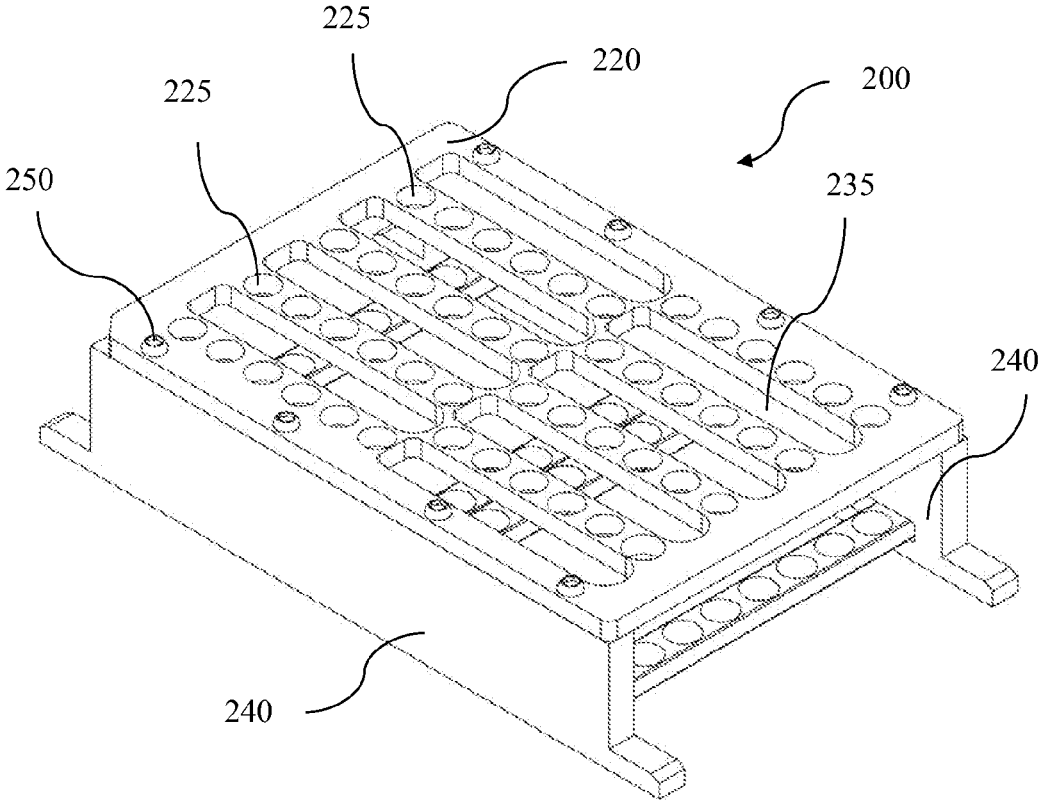
FIG. 2 is a schematic diagram for sample tray of the present invention.

Please refer to FIG. 2 which illustrates the sample tray of the present invention. As shown in FIG. 2, the sample tray 200 of the present invention includes a plate portion 220, which is equipped with plural inserting holes 225 and plural inserting grooves 235, and a support portion 240 which is used for supporting the plate portion 220.

In the present invention, the material of plate portion 220 may be the same as, or different from, that of support portion 240. Specifically, the materials of plate portion 220 and support portion 240 may be polypropylene, polyethylene, polycarbonate, PVC, acryl, aluminum or iron respectively, but are not limited thereto. Attention should be paid to one point that when the material of plate portion is metal, it also functions as heat conducting. In the present embodiment, the materials of plate portion 220 and support portion 240 are polypropylene and aluminum respectively.

In order to make plate portion 220 and support portion 240 be better connected, the sample tray 200 of the present invention may further include a fixing component 250 which is used for fixing plate portion 220 on support portion 240. In the present embodiment, the fixing component 250 is rivet.

In addition, in order to effectively produce the sample tray of the present invention, it can be integrally formed, if so, preferably, the materials of plate portion and support portion are the same.

Figure 3:
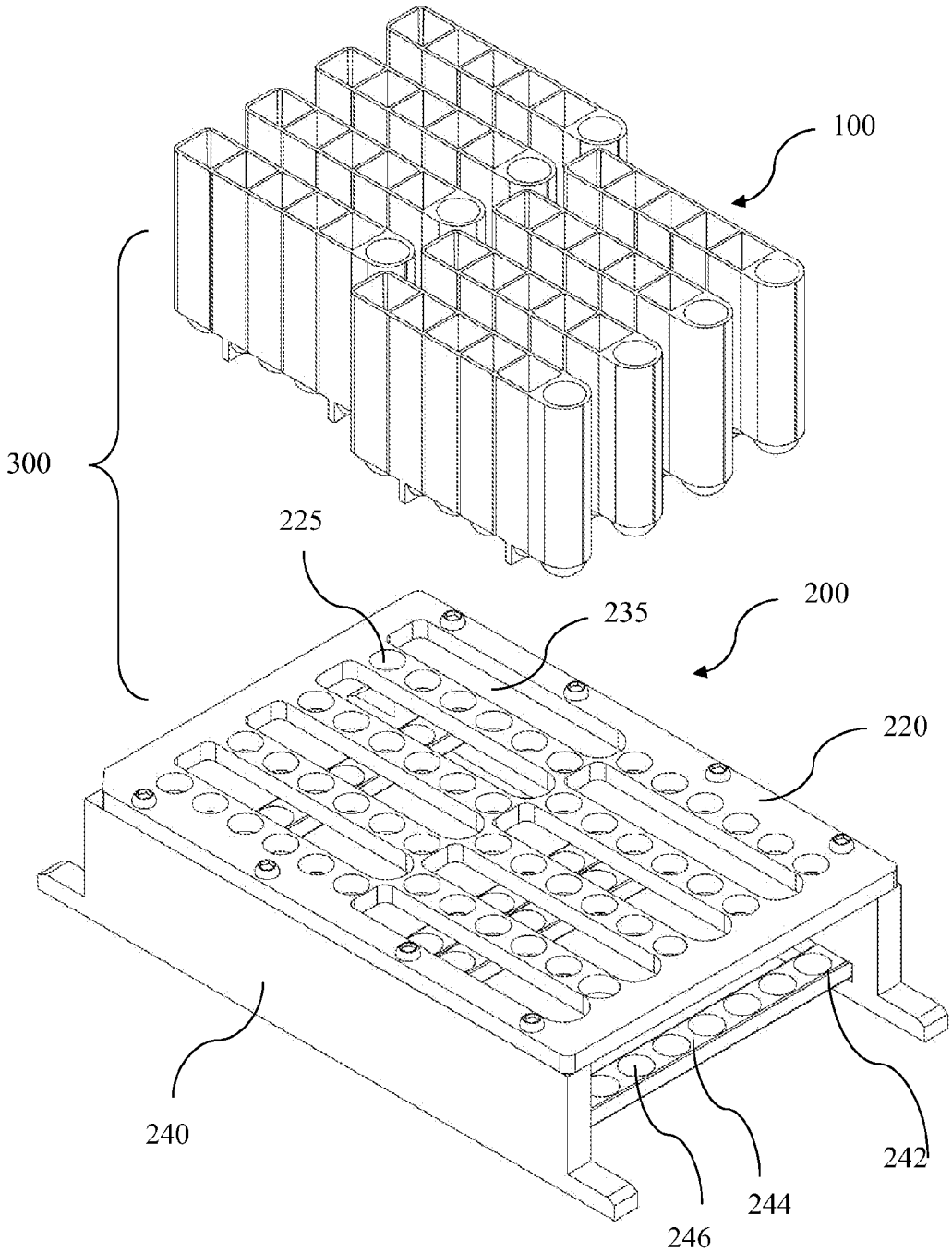
FIG. 3 is a decomposition diagram for combination kit of the present invention used in biochemical test.

Please refer to FIG. 3 which illustrates the combination kit of the present invention which is used in biochemical test. Wherein, the reagent slot 100 has not been placed in the sample tray 200 yet. As shown in FIG. 3, the combination kit 300 of the present invention which is used in biochemical test contains the aforesaid reagent slot 100 and the aforesaid sample tray 200. In combination kit 300, the numbers of inserting holes 225 and inserting grooves 235 contained by the sample tray 200 may be adjusted according to actual demand, but are not limited specially, for example, the sample tray 200 may contain 48 to 90 inserting holes 225 and 1 to 8 inserting grooves 235. Similarly, the number of holding holes 20 of the reagent slot 100 may be adjusted according to actual demand, for example, the reagent slots 100 has 4 to 12 holding holes 20. Generally speaking, in order to make the combination kit 300 able to be used in the 96-well plate machine, the overall appearance of combination kit 300 is roughly consistent with 96-well plate, that is, the plate portion 220 of combination kit 300 is flat and has 8 reagent slots 100 and 48 inserting holes 225, and each reagent slot 100 has 6 holding holes 20. As shown in FIG. 3, the inserting hole 225 and the inserting groove 235 are positioned in the plate portion 220 in the way that there are 6 inserting holes 225 and 1 inserting groove 235 in each row and there are 8 rows in total. The number of holding holes 20 contained by the aforesaid reagent slot 100 may be changed according to actual demand without being limited by the aforesaid description. The aforesaid arranging mode may be adjusted and changed according to actual demand in use. As the number of reagent slots in the combination kit of the present invention may be adjusted according to actual demand in use, this can help avoid consumable waste.

In the present invention, the holding hole 20 of reagent slot 100 can be used for loading reaction reagent, for example, loading reagent used for nucleic acid extraction, but is not limited thereto. Generally speaking, the holding hole 20 may contain at least 0.2 mL sample, at least 2.2 mL sample preferably. In the present embodiment, the holding hole 20 may contain at least 2.2 mL sample.

In the combination kit 300 of the present invention, the inserting hole 225 of plate portion 220 is used for holding tube which can contain sample. Preferably, the tube is a test tube or a centrifuge tube. As for sample, it may be specimens, lysis solution or cleaning solution, but is not limited thereto.

Figure 4:
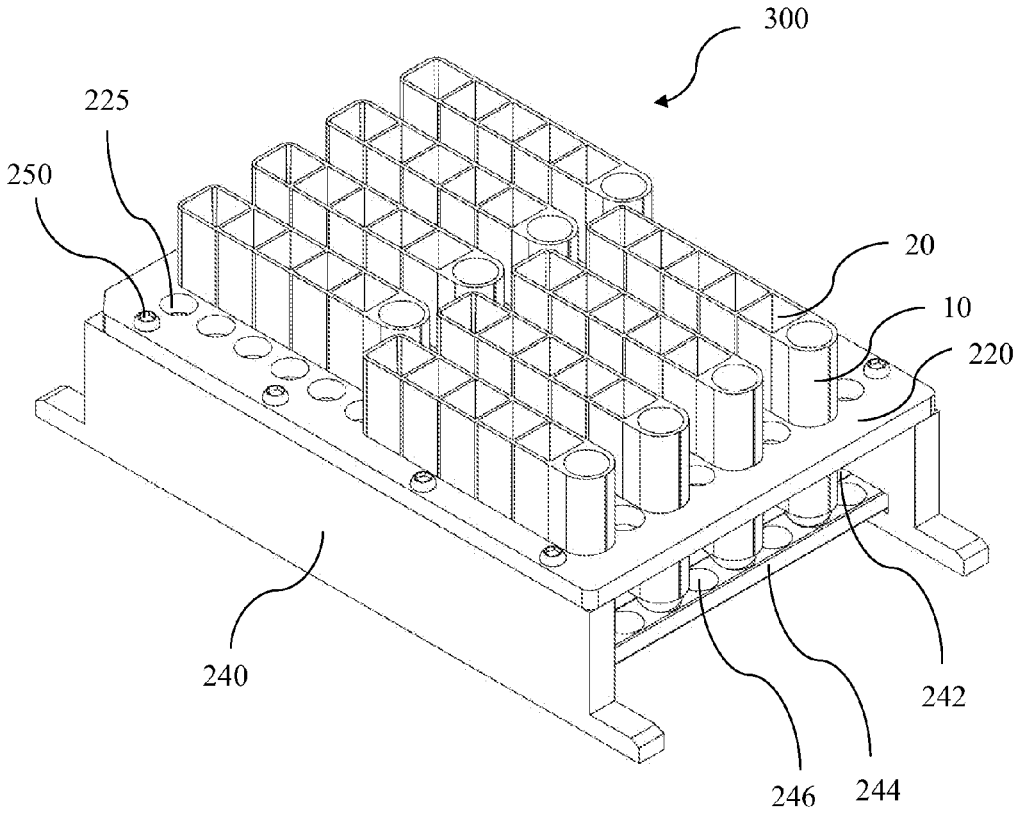
FIG. 4 is a schematic diagram for combination kit of the present invention used in biochemical test.

Please further refer to FIG. 4 which illustrates the combination kit of the present invention which is used in biochemical test. Wherein, the reagent slot is placed in the sample tray 200. As shown in FIG. 4, in the present embodiment, the inside of support portion 240 is equipped with a groove 242 on which at least one heat conducting block 244 is mounted, and the heat conducting block 244 can be moved on groove 242. The heat coming from heating device (not shown) may be conducted to the reagent slot 100 or the tube with loading sample (not shown) by using heat conducting block 244 so as to heat the sample. Since the heat conducting block 244 can be moved on the groove 242, the samples contained in different reagent slots can be heated by moving the heat conducting block 244. Generally speaking, the material of heat conducting block 244 is preferably copper, iron or aluminum. In addition, the heat conducting block 244 also functions as a supporting for tube or reagent slot 100 to make them be placed in the sample tray 200 firmly. As shown in FIG. 4, in the present embodiment, notch 246 is placed on the heat conducting block 244. The number of the notch 246 may be adjusted according to the number of articles placed on it, and its shape may be adjusted according to the bottom shape of the articles placed on it to make the articles on it be firmly placed on it.

In conclusion, as the number of reagent slot of combination kit in the present invention can be adjusted according to actual demand in use, hence, this helps avoid consumable waste and then helps lower research cost of biochemistry aspect and it has huge development value.

What is claimed is:

1. A sample tray, comprising:

a plate portion, equipped with plural inserting holes and plural inserting grooves;

a support portion, having a groove equipped inside of the support portion; and at least one heat conducting block, mounting and movable on the groove, wherein the sample tray is used for bearing a reagent slot, wherein the plate portion is flat, and 6 inserting holes and 1 inserting groove in each row and 8 rows in total are positioned in the plate portion.

2. The sample tray according to claim 1, wherein the inserting holes are used for holding a tube capable of loading a sample.

3. The sample tray according to claim 2, wherein the tube is a test tube or a centrifuge tube.

4. The sample tray according to claim 2, wherein the sample is a specimen, a lysis solution or a cleaning solution.

5. The sample tray according to claim 1, wherein the inserting grooves are used for holding the reagent slots capable of loading reaction reagents.

6. The sample tray according to claim 1, wherein the plate portion is equipped with 48 to 90 inserting holes.

7. The sample tray according to claim 1, wherein the plate portion is equipped with 1 to 8 inserting grooves.

8. A combination kit for biochemical test, comprising:

a reagent slot comprising a main frame having plural holding holes; and a sample tray comprising a plate portion equipped with plural inserting holes and plural inserting grooves, and a support portion having a groove equipped inside of the support portion; and at least one heat conducting block mounting and movable on the groove, wherein the reagent slot is used to be mounted in an inserting groove of the sample tray, wherein the sample tray is used for bearing a reagent slot, wherein the plate portion is flat, and 6 inserting holes and 1 inserting groove in each row and 8 rows in total are positioned in the plate portion.

9. The combination kit according to claim 8, wherein the holding holes are used for loading reaction reagents.

10. The combination kit according to claim 8, wherein the reagent slot comprises 4 to 12 holding holes.

11. The sample tray according to claim 1, wherein the reagent slot comprises a main frame having plural holding holes.

12. The sample tray according to claim 11, wherein the holding holes are used for loading reaction reagents.

13. The sample tray according to claim 1, wherein the reagent slot comprises 4 to 12 holding holes.

14. The sample tray according to claim 1, further comprising a notch placed on the heat conducting block.

15. The combination kit according to claim 8, further comprising a notch placed on the heat conducting block.

* * * * *